United States Patent [19]

Yang

[11] 4,185,347

[45] Jan. 29, 1980

[54] BOOT STRETCHER

[76] Inventor: Seung H. Yang, 41-31 51st St., Long Island City, N.Y. 11377

[21] Appl. No.: 914,136

[22] Filed: Jun. 9, 1978

[51] Int. Cl.[2] ..... A43D 5/00

[52] U.S. Cl. ..... 12/114.6

[58] Field of Search ..... 12/114.2, 114.6, 115.6, 12/116.8, 117.2

[56] References Cited

U.S. PATENT DOCUMENTS

| | | | |
|---|---|---|---|
| 20,185 | 5/1858 | Willmott | 12/114.6 |
| 2,006,419 | 7/1935 | Thomas | 12/114.6 |
| 3,965,515 | 6/1976 | Moberly | 12/114.6 |

*Primary Examiner*—Patrick D. Lawson

*Attorney, Agent, or Firm*—C. Leon Kim; Roland A. Dexter

[57] ABSTRACT

A boot stretcher for selectively stretching all or different portions of a boot, comprising interconnected front and rear halves which comprise a main body that generally conforms to the overall shape of the upper or calf portion of the boot. The halves are movable in opposite directions for selectively stretching the boot and are interconnected by means of a linkage operably associated with a longitudinally threaded rod which can be manipulated by hand to move the halves between various closed and extended or spread apart positions for accomplishing the stretching operation.

9 Claims, 5 Drawing Figures

BOOT STRETCHER

BACKGROUND OF THE INVENTION

The present invention relates to an improved boot stretcher for selectively stretching all or different portions of a boot.

Typically, boots which are not laced or buckled and comprise an elongated calf or upper portion often require some adjustment in order to fit comfortably on the wearer. Also while certain portions of the boot may fit comfortably, there may be a certain amount of discomfort due to tightness in other portions of the boot which require some permanent deformation or stretching.

Generally there have been devices available for stretching boots and shoes; however, they have usually been relatively complicated both in construction and operation. One such device is shown in U.S. Pat. No.2,170,754 wherein there is illustrated a combined boot and shoe stretching and lengthening mechanism. Another prior art device used for stretching the boot leg is shown in U.S. Pat. No. 3,276,053. The stretching device of this particular disclosure requires fairly complicated means and dual handles with multiple shafts for selectively moving different portions of the opposed boot stretching members in the desired directions. It also relies on totally separate spring-biased means for connecting and urging the members in their opposed outward directions. The wedge members which cam the boot stretching members in opposite directions are separate and distinct from the means for securing the two halves together as are the shafts for moving the upper and lower wedge members, respectively. Still yet another prior art device is shown in U.S. Pat. No. 3,965,515 wherein there are illustrated opposed boot stretcher halves interconnected by upper and lower linkage arrangement, with the linkage fixed to one of the halves and slidably movable with respect to the other half. Separate screw members are provided for engaging the linkage to cause the boot stretching members to move in the desired manner.

SUMMARY OF THE INVENTION

Thus, while there have been shown in the prior art some attempts of providing boot stretcher devices, none are considered to be as advantageous and simple both from a construction and operational viewpoint as the present invention. According to the present invention there is provided a boot stretcher for selectively stretching all or different portions of a boot, comprising front and rear halves which comprise a main body that generally conforms to the overall shape of the upper or calf portion of the boot. The halves are movable in opposite direction for selectively stretching the boot and are interconnected by means of a linkage operably associated with a longitudinally threaded rod which can be manipulated by hand for causing the halves to spread apart in the desired fashion for accomplishing the stretching operation. There are upper and lower linkage with one being fixed on the rod and the other movable along the rod for urging the linkage into and extended position. Latching means are at either end of the body for selectively spreading different parts of the halves upon turning the handle.

Other features of the present invention construction and arrangement will become apparent upon reading of the following detailed description of a preferred embodiment of the invention when taken in conjunction with the accompanying drawings.

DESCRIPTION OF THE PREFERRED EMBODIMENTS

Figure 1:
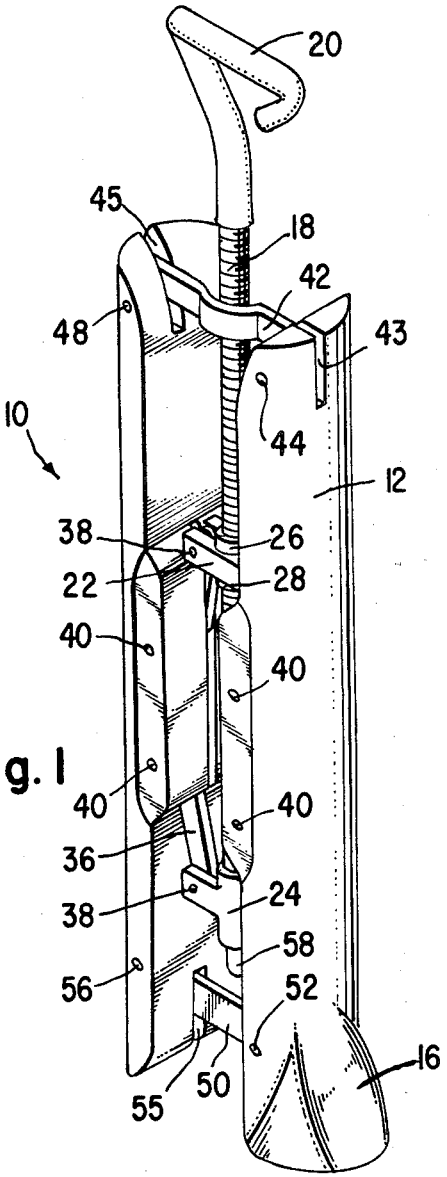
FIG. 1 is a perpective view of a boot stretching device according to the present invention.
Figure 5:
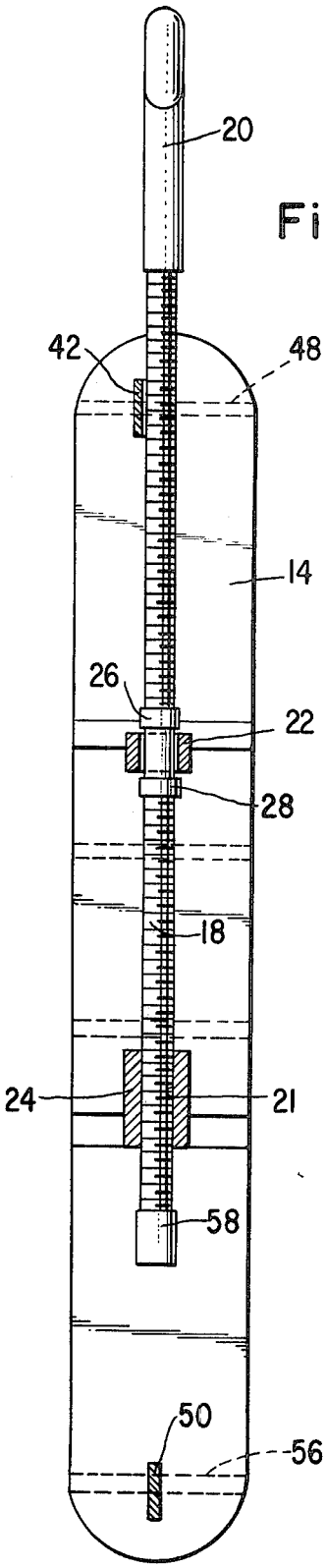
FIG. 5 is a cross-sectional view taken substantially on the line 5—5 of FIG. 4.

Referring now to the drawings wherein like parts are designated by the same reference numeral throughout the several views, there is shown in FIG. 1 a boot stretcher device 10 according to the present invention. The device has a main body which comprises front and rear halves 12 and 14 which are constructed from relatively rigid but sturdy smooth surface materials such as wood, aluminum, plastic or plastic-covered wood. The overall shape of these members is generally similar to the shape of the boot in the region of the calf or upper boot portion. The front half member 12 includes an instep portion 16 at the bottom end thereof. The halves are interconnected by means of expandable linkage arrangement which coact with a threaded rod member 18 such that the halves can be spread apart or brought together uniformly or at selected areas thereof. The main elongated threaded rod 18 has at its upper end a handle 20 and has along its length a pair of bored or lineage support members 22, 24 which surround the rod and may be identical or different as shown. The bottom member 24 is threaded at 21 (FIG. 5) for cooperation with the threads of the rod 18 while the upper member 22 is fixed in position on the rod by means of upper and lower abutment members 26, 28 which can be separate or integrally formed protuberances in the rod. The portion of the rod about which the upper fixed member 22 is disposed can be smooth, that is without the threads. Each of the members is connected with the front and rear boot stretcher members 12, 14 by pivotally mounted linkage members 30, 32 and 34, 36, respectively. Each of these links is pivotally secured about a spindle 38 to the rod and at its opposite end is pivotally mounted to a further spindle 40 which is secured with the front and rear halves of the boot stretcher. In accordance with the preferred embodiment, the bottom member 24 threadingly engages the rod as the latter is turned in one direction to move in an upward direction thereby causing the associated links to extend outward from the rod axis into a maximum extended generally perpendicular position relative to the rod's turning axis, which spreads the front and rear halves apart. At the same time the upper fixed member will move with the rod in a corresponding direction also causing its associated links to move similar to those with the movable member.

Figure 3:
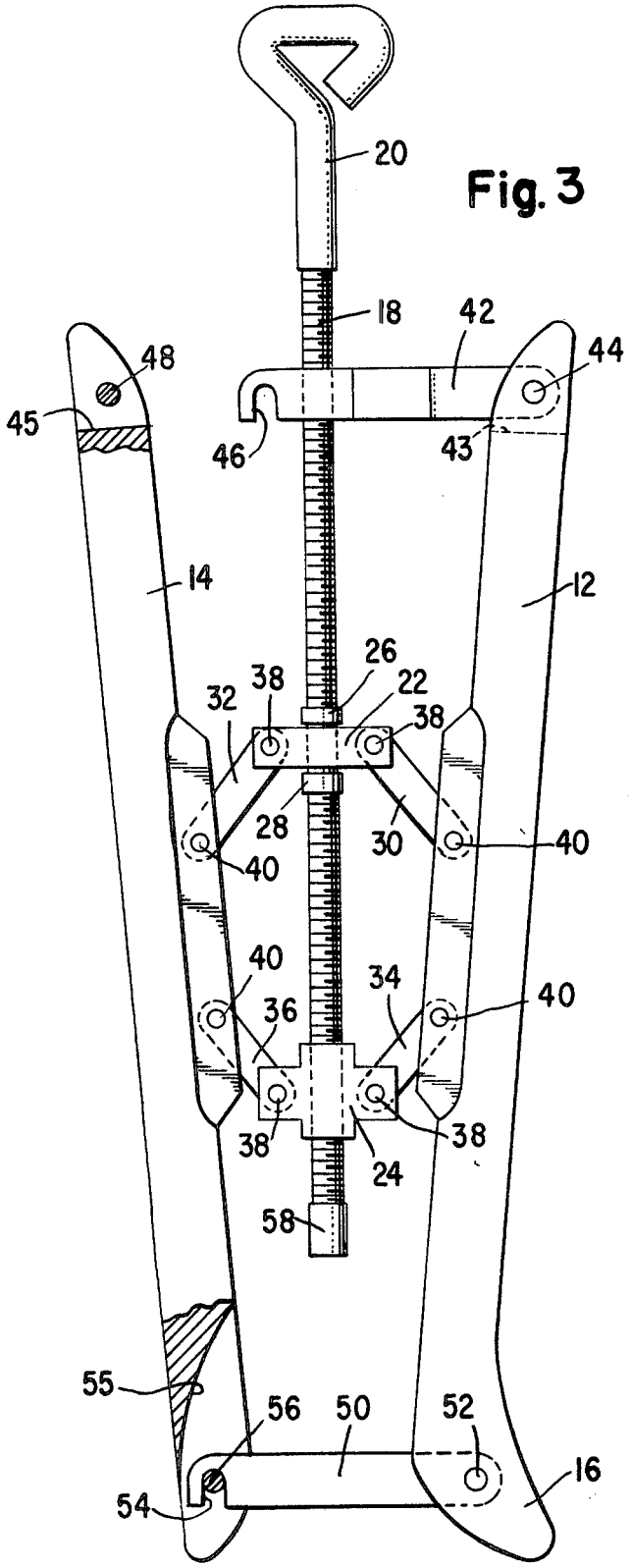
FIG. 3 is a side elevation view of the boot stretcher of FIG. 1 with the bottom latch engaged, for stretching upper parts of the boot.

At opposite ends of the boot stretcher are provided latching means comprising a pivotally mounted latch member 42 mounted, for example, to the front member 12 by a fixed rod 44 mounted transversely of slot 43 and having a latch hook end 46 at its free end for releasably engaging a rod or post member 48 also transversely disposed of slot 45 provided on the opposite surface of the rear half 14. A similar latching arrangement is provided at the bottom of the boot by means of the members 50, 52, 54 and 56 as shown in FIG. 3, for example, with latch 50 engaged. The bottom end of rod 18 has an enlarged portion 58 for preventing the member 24 from becoming detached from the rod.

Figure 2:
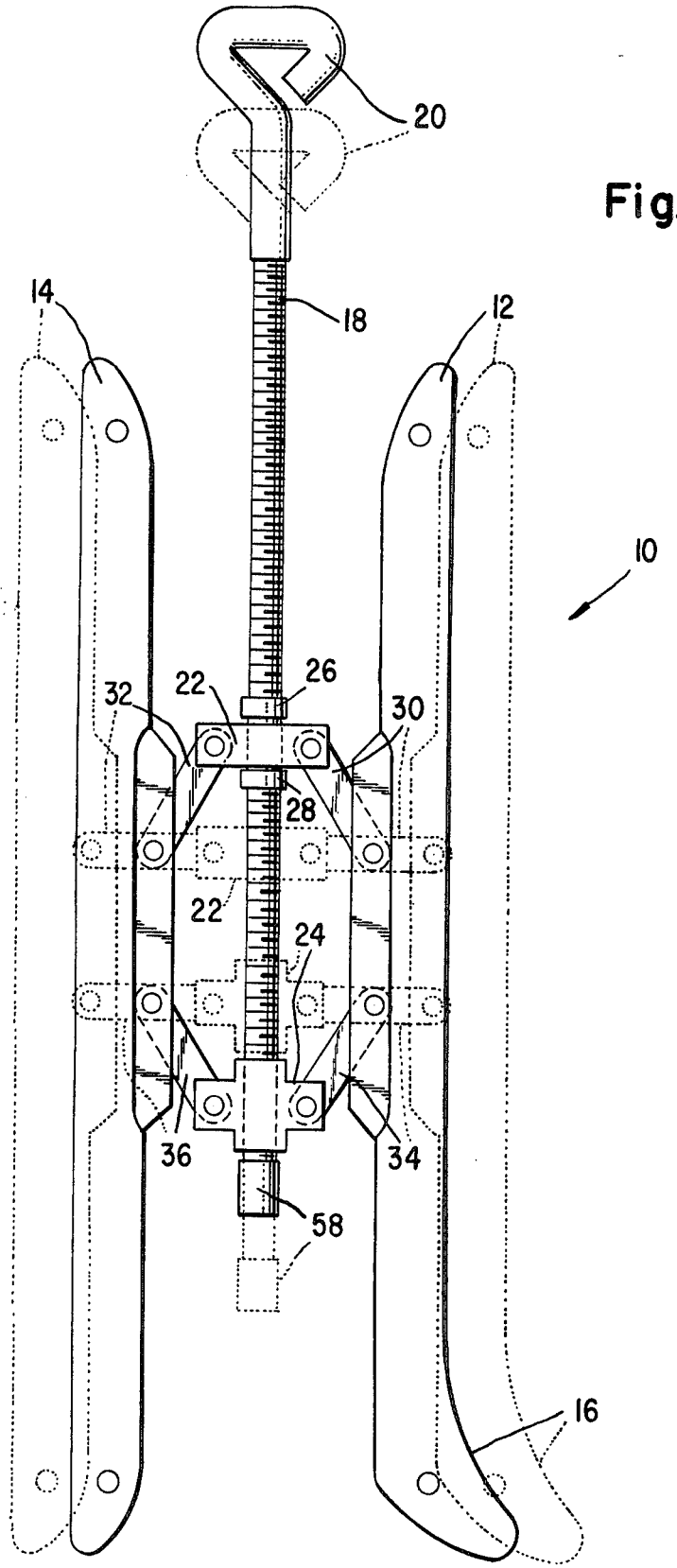
FIG. 2 is a side elevation view of the boot stretcher of FIG. 1 in its closed position (solid) and open position (broken).
Figure 4:
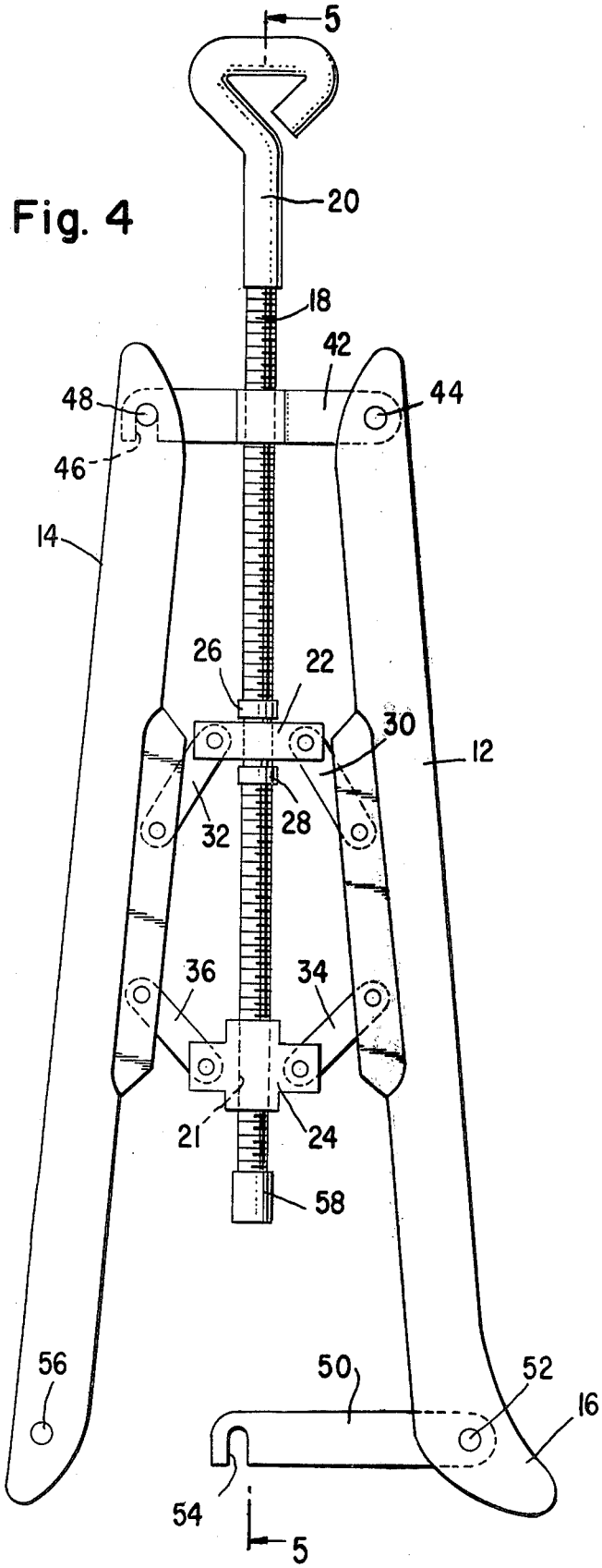
FIG. 4 is a side elevation view of the boot stretcher of FIG. 1 with the upper latch engaged, for stretching lower parts of the boot.

The boot stretching device according to the present invention would operate in the following manner. The normal stored position of the device is best illustrated in the closed position (solid line) of FIG. 2. If it is desired to stretch the calf or upper portion of the boot along its entire length, then the device in its closed position, but with the latch means 42, 50 released, is inserted into the calf position of the boot whereupon the rod member 18 is turned or rotated by means of the handle 20 to cause the front and rear portions 12, 14 of the boot stretcher to move in opposite directions with the linkage members generally tending to approach a position or orientation perpendicular to the turning rod axis until the members 12, 14 generally engage the boot surface. The handle is turned until the boots are stretched to the desired position in which they are left for a period of time to obtain the desired permanent deformation of the boot, as illustrated by the position formed by the dotted lines in FIG. 2. On the other hand, if it is desired to stretch only a portion of the boot, for example the bottom of the calf portion, then the upper latch 42 is engaged such that the upper ends of the halves are maintained in a relatively fixed position, whereupon the handle is turned until the bottom end of the halves are disposed in a generally outwardly disposed position such that the boot is stretched in that area. The general configuration of the members takes the form of an inverted-V, as illustrated in FIG. 4. If it is desired to stretch the upper portion of the boot then reverse procedure is followed: that is, only the bottom latch is engaged (the upper latch is open or unlocked) and the handle is turned whereby the bottom member 24 will tend to move upwardly causing the unlocked upper end of the halves to move outwardly relative to each other thereby stretching that portion of the boot. The configuration of the device will then comprise a normal "V" configuration, as shown in FIG. 3.

It can be seen that the present invention provides a very simple inexpensive device for stretching the entire calf portion of the boot or only selected portions thereof. The device requires only a fixed and a movable point along the threaded rod and has simple latching mechanism for determining the overall configuration of the device in order to stretch the desired portion of the boot. While there has been illustrated and described in the preferred embodiment that the bottom member threadingly engages the rod while the upper one is fixed it is also possible for the upper member to threadingly engage and coact with the rod as it is turned, while the bottom member is fixed in its position relative to the rod. Also, the latching mechanism can take a variety of forms such as releasable spring-biased latches or clasps and the like.

What is claimed is:

1. Apparatus for selectively stretching all or portions of a boot comprising: a main boot stretching body comprising front and rear halves generally conforming to the shape of the boot portion to be stretched; a rotatable elongated rod; first and second expandable pivotally mounted linkage means inter-connecting said body halves and mounted for cooperation with said rotatable rod for causing relative movement of said halves in opposite directions; said first linkage means being movable relative to said rod and said second linkage means being fixed relative to said rod; and, a first and second latching means located exterior of said first and second linkage means operably associated with said front and rear halves for enabling at least a selected portion of said front and rear halves to spread apart from their normal position when said latching means connects an end of said halves.

2. The apparatus of claim 1 wherein said first and second latching means comprises an upper pivotal latch member and a lower pivotal latch member disposed on one of said halves for selectively connecting either of the upper and lower ends of said halves during operation of said apparatus.

3. The apparatus of claim 1 wherein at least one of said first and second latching means contains a depression in its surface for cooperation with said rod when in latched position between said front and rear halves.

4. The apparatus of claim 1 wherein said rod comprises a threaded member extending longitudinally between said halves and threadingly engaging said first linkage means.

5. The apparatus of claim 2 wherein each of said linkage means includes a bore member disposed about said threaded rod and having links pivotally connected between said bore member and said front and rear halves, respectively.

6. The apparatus of claim 2 wherein each of said linkage means comprises front and rear pivotally mounted links for pivotally engaging each of said front and rear halves.

7. The apparatus of claim 2 wherein the bottom one of said first and second linkage means is movable relative to said threaded rod and the upper one of said linkage means is fixed in position.

8. The apparatus of claim 2 wherein each of said linkage means comprises front and rear links for interconnecting said threaded rod with said front and rear halves, respectively, for moving said front and rear halves equidistant relative to said turning axis of said threaded rod upon operation thereof.

9. The apparatus of claim 3 wherein said first and second latching means are rectangular blade-like members each containing said depression for cooperation with said rod.

* * * * *